United States Patent [19]

Fujikawa et al.

[11] 4,198,906

[45] Apr. 22, 1980

[54] CODE IMPRINTING SYSTEM HAVING ERROR PRECLUSION FUNCTION

[75] Inventors: Tsuneo Fujikawa, Ebina; Syunichi Aoki, Yokohama; Naoki Sasaki, Zama, all of Japan

[73] Assignee: Nissan Motor Company, Limited, Yokohama, Japan

[21] Appl. No.: 890,979

[22] Filed: Mar. 28, 1978

[30] Foreign Application Priority Data

Apr. 28, 1977 [JP] Japan ..... 52-49390
Apr. 28, 1977 [JP] Japan ..... 52-49389

[51] Int. Cl.[2] ..... B41F 17/00

[52] U.S. Cl. ..... 101/42; 101/99; 400/74; 364/900

[58] Field of Search ..... 101/18, 35, 42, 43, 101/93, 93.1, 79, 99; 400/154.4, 162.3, 73, 74

[56] References Cited

U.S. PATENT DOCUMENTS

| | | | |
|---|---|---|---|
| 3,049,992 | 8/1962 | Brown et al. | 101/99 |
| 3,141,403 | 7/1964 | Brown et al. | 101/99 |
| 3,312,939 | 4/1967 | Bell et al. | 400/74 X |
| 3,388,782 | 6/1968 | Schwend | 400/154.4 X |
| 3,504,622 | 4/1970 | Morrison | 101/99 |
| 3,622,702 | 11/1971 | Larew et al. | 400/73 |
| 3,732,812 | 5/1973 | Bremner | 101/99 |
| 3,833,795 | 9/1974 | Shoshani et al. | 101/72 |
| 4,027,764 | 6/1977 | Kashio | 400/74 |

*Primary Examiner*—Clifford D. Crowder

[57] ABSTRACT

The system is used for imprinting indentification code on individuals of articles such as automobiles produced in quantity, particularly on an assembly line, and comprises an instruction unit to provide a data signal representing an identification code to be imprinted, a stamping machine in which setting of imprinting types is performed automatically according to the data signal, a sensor which provides a signal representing an actual state of the type setting, and a comparator which provides an operation signal to the stamping machine only when the signal from the sensor agrees with the data signal and otherwise provides an alarm signal. For further accuracy of imprinting operation, the system may include a sensor to detect the type of the individual article to be imprinted and another comprator to prevent the action of the stamping machine also when the type of the article differs from one implied by the data signal.

8 Claims, 7 Drawing Figures

| | CONTACT STATE | | | | |
|---|---|---|---|---|---|
| | 0 | 1 | 2 | 3 | 4 |
| | "0" | "1" | "2" | "4" | "8" |
| 0 | | – | – | – | – |
| 1 | | × | – | – | – |
| 2 | | – | × | – | – |
| 3 | | × | × | – | – |
| 4 | | – | – | × | – |
| 5 | | × | – | × | – |
| 6 | | – | × | × | – |
| 7 | | × | × | × | – |
| 8 | | – | – | – | × |
| 9 | | × | – | – | × |

× : ON

– : OFF

CODE IMPRINTING SYSTEM HAVING ERROR PRECLUSION FUNCTION

BACKGROUND OF THE INVENTION

This invention relates to an automated imprinting system for imprinting identification code on individuals or articles such as automobiles produced in quantity, particularly on an assembly line, and more particularly to the preclusion of incorrect imprinting during operation of the system.

A system according to the invention is of use in the production of various kinds of articles, but the assembly of automobiles on an assembly line will be taken as a typical example in the following description.

At present it is usual that automobiles of various types and/or models are assembled on a single assembly line in an irregular order. The assembly operation includes a step of stamping or imprinting identification number or code on each of the half-assembled car bodies with alteration of identification code for each individual. The identification code consists of several components which respectively imply the type, model, serial number, etc. and is necessary to the registration of the manufactured cars in government offices.

In a production program a specific identification code is assigned to each individual car to be assembled on an assembly line, and the order of assembling cars of various types and/or models on the same assembly line is indicated by an arrangement of identification codes for all cars in the production program. According to a traditional method, the arrangement or setting of imprinting types of a stamping machine is altered manually for each car on the assembly line. This method is unfavorable to the productivity since an operator of the machine needs to refer to a copy of the production program to accomplish each alteration procedure. Currently, therefore, use is made of an automated stamping machine which has the ability of altering the setting of the imprinting types in response to an electrical signal representing an identification code to be imprinted next. The imprinting step is eased by this method. However, there is a possibility that the automated type-setting mechanism functions erroneously or that the electrical signal does not accurately represent an intended identification code because of, for example, malfunction of a tape reader used for producing the signal. Accordingly a worker must confirm the arrangement of the imprinting types after each action of the automated type-setting mechanism since it is very important to preclude the occurrence of an incorrect imprinting. The imprinting of an incorrect identification code on a half-assembled car will introduce confusion to the workers on work spots downstream of the imprinting spot. Moreover, there is a chance that a car component such as an engine of an unintended type or model is installed on the incorrectly marked car. In addition, there is a possibility that two cars are registered to a government office under the same identification code as the result of an incorrect marking since the imprinting of identification code is usually done also on a copy tape which is submitted subsequently to a government office. Correction of such erroneous registration requires troublesome proceedings.

From a different point of view, it may not be expected that cars (or their parts) of various types or models are conveyed along the assembly line always in the order according to the production program. Accordingly a worker on the imprinting spot must confirm that each half-assembled car arrived at the imprinting spot is of an intended type and model and that the car to be imprinted and the identification code set in the imprinting mechanism are in accordance with one another.

From the above described reasons, it is rather difficult to say that the employment of an automated imprinting machine has produced a substantial improvement in productivity.

SUMMARY OF THE INVENTION

It is an object of the present invention to provide an automated code imprinting system of the above described use, which system has the ability of self-detecting the occurrence of an incorrect setting of imprinting types and stopping the imprinting operation upon detection of the incorrect type setting.

It is another object of the invention to provide an automated identification code imprinting system of the above described use, which system has, in addition to the above described ability, the ability of detecting the type or model of an article to be marked and stopping the imprinting operation upon detection of a difference in the type or model of the article from an expected one.

It is a still another object of the invention to provide an automated identification code imprinting system of the above described use, which system can perform imprinting operation without the possibility of imprinting an identification number or code not in agreement with one specified in a production program and has self-checking and error warning abilities, allowing the elimination of a check work as long as the system gives no warning.

An automated imprinting system according to the invention comprises the following components:

(a) an instruction unit to produce an electrical data signal representing an identification code specified in a production program, (b) a control unit to produce an electrical control signal representing the identification code based on the data signal, (c) an automated stamping machine having a type-setting mechanism which sets up imprinting types into an arrangement corresponding to the identification code in response to the control signal supplied from the control unit and a driving mechanism to carry out a stamping action in response to an electrical operation signal, (d) a sensor for detecting actual arrangement of the imprinting types and producing an electrical signal representing the detected arrangement, and (e) a comparator which compares the type arrangement signal supplied from the sensor with the data signal supplied from the instruction unit and provides the aforementioned operation signal to the stamping machine only when the type arrangement signal agrees with the data signal and provides a warning signal if the type arrangement signal does not agree with the data signal.

As will be apparent from the described construction, this imprinting system does not effect imprinting if the arrangement of the imprinting types resulting from the action of the type-setting mechanism does not correspond to the intended identification code. Accordingly the imprinting of an incorrect identification code can surely be precluded even if any of the instruction unit, control unit or the type-setting mechanism exhibits malfunction.

For example, the contents of the production program are stored in a punched tape with the provision of a tape reader as part of the instruction unit. The type-setting mechanism may comprise a plurality of parallel-arranged type wheels each having some imprinting types on the periphery, a pneumatic actuator for each type wheel, a gear train for each type wheel to rotate it stepwise by the action of the actuator, and an electromagnetic valve for each actuator to control the application of pneumatic pressure to the actuator in response to the control signal. The sensor may be a combination of a plurality of digital switches, which are respectively assigned to the type wheels and each produce a four-bit signal representing the angular position of the assigned type wheel with respect to the axis of rotation.

In a case where a system of the invention is embodied into an imprinting system for use in the assembly of automobiles of various types and models on one assembly line, it is preferably that the imprinting system comprises the following components:

(a) the above described instruction unit, (b) the above described control unit, (c) the above described stamping machine, (d) the above described type arrangement sensor, (e) a first comparator which compares the type arrangement signal supplied from the sensor with the data signal supplied from the instruction unit and produces a first correctness signal only when the compared signals agree with each other and produces a warning signal if the compared signals do not agree with each other, (f) a sensor for detecting the model (in the sense of type and/or model) of a car body on which the identification code is to be imprinted and producing an electrical signal representing the detected car model, (g) a second comparator which compares the car model signal with a car model component of the data signal supplied from the instruction unit and produces a second correctness signal only when the compared signals agree with each other but producs a warning signal if the compared signals do not agree with each other, and (h) a judgement unit which provides the operation signal to the stamping machine only when both the first and second correctness signals are supplied thereto at a predetermined moment and, preferably, produces an alarm signal if at least one of the first and second signals is not supplied thereto at the predetermined moment.

For example, the car model sensor comprises at least one probe which has a switch capable of closing or opening in dependence on the shape or position of a specific part of a car body such as an aperture for a steering shaft.

Thus, when this imprinting system is employed, the imprinting of an incorrect identification code can surely be precluded even if there occurs either an error in the setting of the imprinting types, or in the transformation of the input data, or confusion of the car flow along the assembly line.

DESCRIPTION OF PREFERRED EMBODIMENTS

Figure 1:
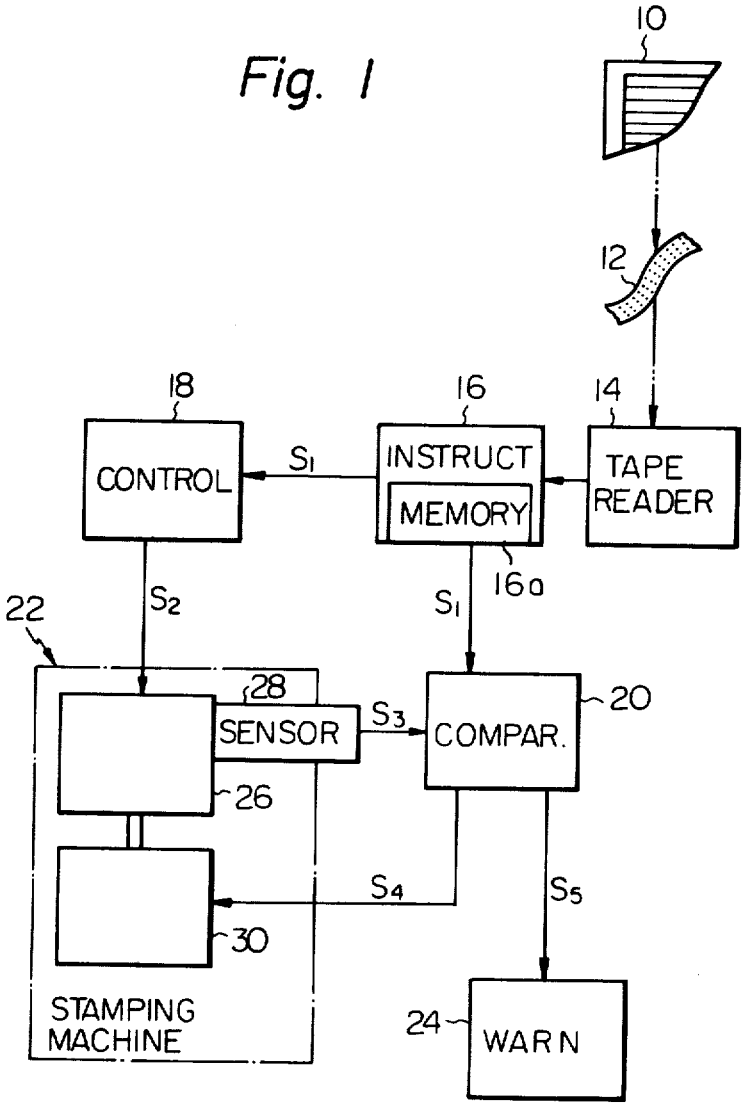
FIG. 1 is a block diagram of an automated imprinting system as an embodiment of the invention.

In FIG. 1, punched tape 12 is utilized to store the contents of a production program 10 and provide the stored data to an automated imprinting system according to the invention. This imprinting system has an instruction unit 16 which is provided with a tape reader 14 and serves as a data acquisition unit. The tape reader 14 reads out the data recorded in the punched tape 12 and produces an electrical signal $S_1$ representing an identification number or code. The instruction unit 16 serves the function of transmitting this data signal $S_1$ to a control unit 18 and, besides, includes a memory circuit 16*a* to memorize this signal $S_1$ temporarily (for a predetermined period of time) and supply the same signal $S_1$ to a comparator 20 continuously for the aforementioned predetermined period of time. A stamping machine 22 which is under the control of the control unit 18 comprises a type-setting mechanism 26, a driving mechanism 30 which puts the mechanism 26 to work and a sensor 28 to detect the position or arrangement of stamps or printing types (hereinafter referred to merely as printing types) in the type-setting mechanism 26. The detail of this machine 22 will be described later. Based on the data signal $S_1$, the control unit 18 supplies an electrical signal $S_2$, which contains the meaning of the signal $S_1$, to an actuator means of the type-setting mechanism 26 so that the printing types may be arranged in accordance with an arrangement implied by the data signal $S_1$. The sensor 28 produces an electrical signal $S_3$ representing the realized arrangement of the printing types. This signal $S_3$ is put into the comparator 20 and compared with the data signal $S_1$. When the two signals $S_1$ and $S_3$ are in agreement, meaning that the printing types are arranged properly, the comparator 20 provides an operation signal $S_4$ to the driving mechanism 30 thereby to allow the machine 22 to imprint an identification number or code on an article ready for imprinting. If the signal $S_3$ does not agree with the signal $S_1$, it is judged that the printing types are arranged improperly or erroneously. In such a case the comparator 20 provides an alarm signal $S_5$ to a visual or aural alarm device 24 instead of providing the operation signal $S_4$. Then an erroneous imprinting can be avoided and an operator or observer of the machine 22 can take a necessary measure.

The above described process is performed for each set of data (representing an identification number or code) read out by the tape reader 12.

As a slight modification, the stamping machine 22 may be constructed so as to take a ready-to-function state upon receipt of the signal $S_4$ from the comparator 20 and perform imprinting upon receipt of a separate command signal from another controller (not shown).

By way of example, the stamping machine 22 will be embodied in a machine to imprint identification code on automobile bodies in an automobile assembly line. The identification code must differ from individual car to individual car. Each identification code is an arrangement of digits and letters and/or symbols as exemplified by "PL810-123456", in which "P" indicates the type of the car, for example being a sedan (not a coupe which will be indicated by a different letter such as "Q"), "L" indicates that the steering wheel is located on the left side ("R" may be used for indicating the right side), "810" indicates the model of the car, and "123456" indicates serial number given to each car individually by the production program 10. This code is stored in the punched tape 12 and transformed into the signal $S_1$, which is a digital signal and is transmitted from the instruction unit 16 to the control unit 18 and the comparator 20.

Figure 2:
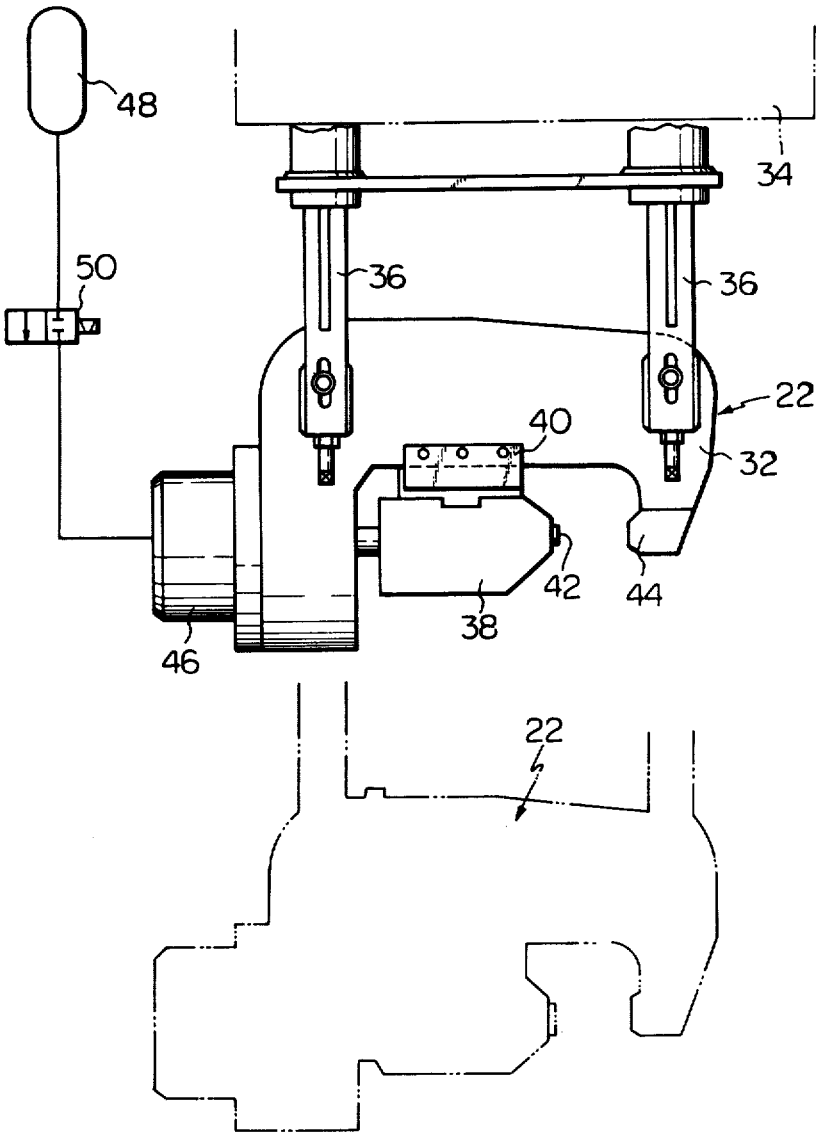
FIG. 2 is an elevational view of a stamping machine used in the system of FIG. 1.

Referring to FIG. 2, a roughly-C-shaped frame of the stamping machine 22 is suspended from a support 34 located high above the assembly line by arms 36 which are extendable and contractable vertically, so that the frame 32 can be lowered at the time of each imprinting operation. A guide 40 is fixed to the frame 32 so as to allow an imprinting head 38 having imprinting types 42 at its front end to slide horizontally by the action of a hydraulic cylinder 46. An electromagnetic valve 50 controls the application of a hydraulic pressure from a hydraulic pressure source 48 to the cylinder 46. The frame 32 has at its one end a base plate or block 44 with a flat face opposite to the imprinting types 42.

Figure 3:
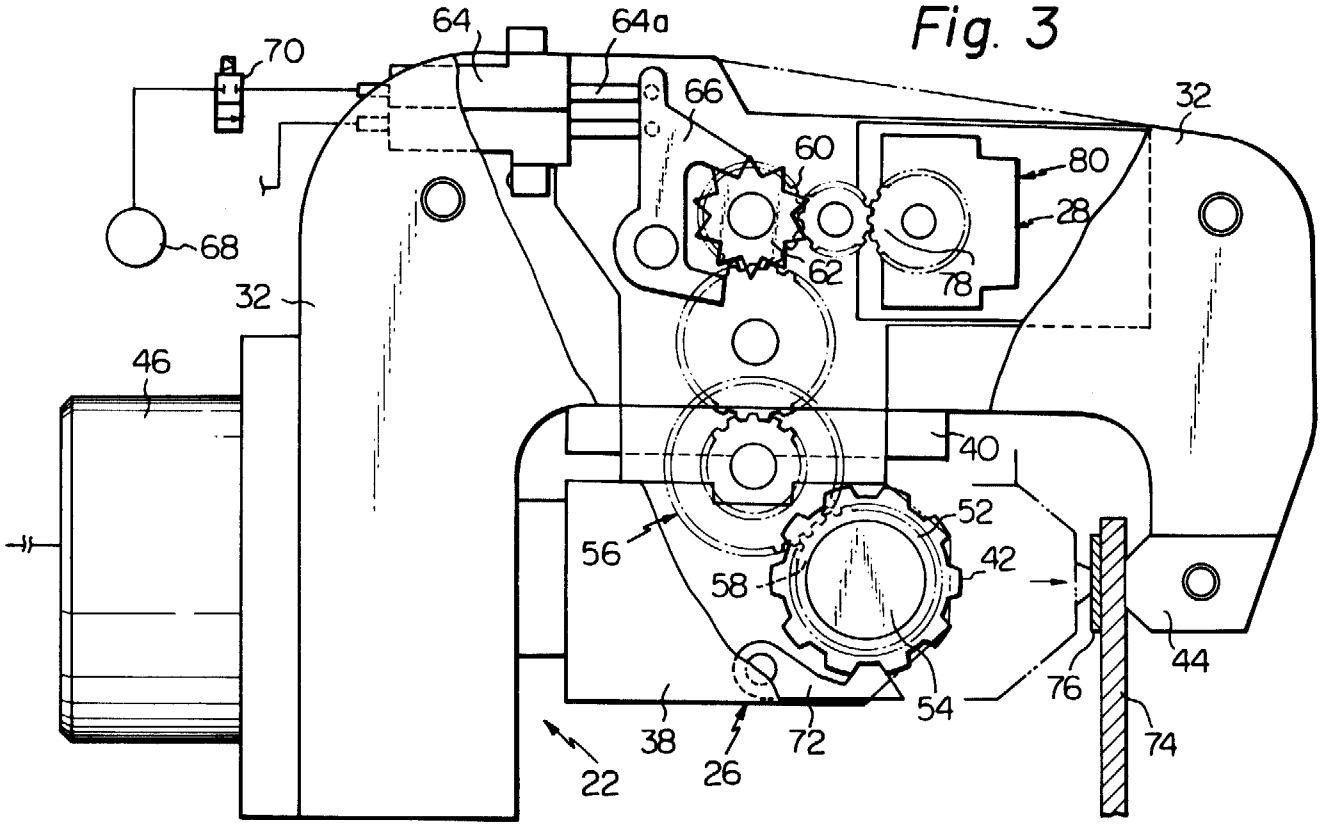
FIG. 3 shows an imprinting mechanism in the machine of FIG. 2 in a partially cutaway view.

The construction of the type-setting mechanism 26 is shown in FIG. 3. The imprinting head 38 has a plurality of type rings or wheels 52 (twelve wheels in the case of imprinting the code "PL810-123456") arranged in parallel and mounted individually rotatably on a common shaft 54 which extends horizontally and normal to the direction of the movement of the head 38. Each of the type wheels 52 has on its periphery a plurality of (usually ten) imprinting types 42 of digits, letters or symbols and is associated with a gear train 56. An end gear wheel 58 of each gear train 56 is mounted rotatably on the shaft 54 and attached to the type wheel 42 assigned to this gear train 56. An intermediate gear wheel 60 of the gear train 56 is attached to a ratchet wheel 62 with a common axis of rotation. The number of the teeth of the ratchet wheel 62 equals to the number of the imprinting types 42 on the associated type wheel 52.

The type-setting mechanism 26 includes a pneumatic cylinder 64 having a reciprocable piston **64*a* for each gear train 56. Indicated at 68 is a compressed air source and at 70 an electromagnetic valve of the on-off function type to control the application of pneumatic pressure to the cylinder 64. A crank lever 66 is attached to the end of the piston 66 with a pawl of the lever 66 in engagement with the ratchet wheel 62 such that each swing of the lever 66 caused by a cycle of reciprocation of the piston 64*a* causes the ratchet wheel 62 to rotate by one pitch of its teeth and accordingly the type wheel 52 to rotate through an angle corresponding to the circumferential distance between two adjacent types 42. The pulse signal $S_2$ is supplied to the electromagnetic valve 70 to cause the piston 64*a* of the hydraulic cylinder 64 to repeat reciprocation a definite number of times necessary for setting a specific imprinting type 42 of the associated type wheel 52 in an imprinting position, i.e. a position opposite and normal to the base 44**.

It will be understood that the above described type-setting process is performed for all of the type wheels 52 simultaneously with the result that the types 42 of the respective type wheels 52 are arranged so as to compose the code "PL810-123456" implied by the signal $S_2$. Then the type wheels 52 are locked by allowing a lock arm 72 having a pawl to engage with the wheels 52.

Thus the type head 38, gear trains 56 and the pneumatic system including the electromagnetic valves 70 and the cylinders 64 in FIG. 3 constitute the type-setting mechanism 26 in FIG. 1. Both the gear trains 56 and the pneumatic cylinders 64 are arranged on a support member (not indicated) which is joined to the type head 38 so as to move horizontally together with the head 38.

In FIG. 3, an end gear wheel 78 of each gear train 56 serves as part of a digital switch 80, meaning the presence of digital switches 80 in the same number as the type wheels 52. These digital switches 80 too are arranged on the aforementioned support member joined to the type head 38, and these digital switches 80 as a whole constitute the type arrangement sensor 28 in FIG. 1.

Figures 4, 5:
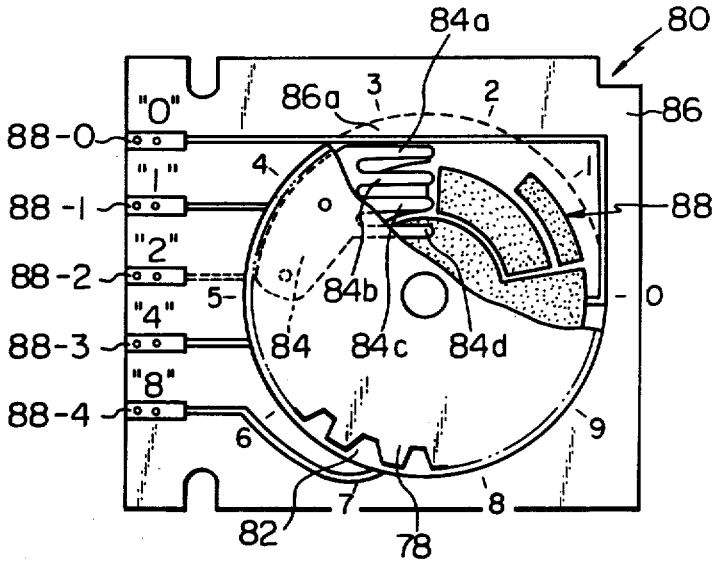
FIG. 4 shows a digital switch used as a type arrangement sensor in the system of FIG. 1 in a partially cutaway plan view.
FIG. 5 is a chart for the explanation of the function of the digital switch of FIG. 4.

Each of the digital switch 80, as shown in FIG. 4, has a disc 82 which is assembled coaxially with the gear wheel 78 so as to be rotated together with the gear wheel 78. A front surface of the disc 82 faces to the gear wheel 78, and a contact plate 84 is placed fixedly on the rear surface of the disc 82. This contact plate 84 has a considerably small area in comparison with the disc 82 and is shaped to have four strip-like branches or arms **84*a*, 84*b*, 84*c* and 84*d* which are parallel to each other with short intervals between them in a direction radially of the disc 82. At a very short distance, a printed board 86 is arranged parallel to the disc 82 with its front surface facing the rear surface of the disc 82. The printed board 86 is stationary and has on its front surface a contact area 88-0 of positive or negative polarity and four contact areas 88-1, 88-2, 88-3 and 88-4 of the reverse polarity. (These five contact areas will be indicated collectively by reference numeral 88.) These contact areas 88 are isolated from each other, respectively shaped and sized differently and arranged such that, as the disc 82 makes a rotational movement stepwise by one-tenth revolution at each step, the contact areas 88-1, 88-2, 88-3 and 88-4 are individually and selectively connected to the contact area 88-0 by partial contact of the contact areas 88 with the arms 84*a*, 84*b*, 84*c*, 84*d* of the contact plate 84** in the manner as explained below.

Referring to FIG. 5, the contact areas 88-1, 88-2, 88-3 and 88-4 are made to represent respectively the places of "1", "2", "4" and "8" for binary numbers. Each of these contact areas 88-1, 88-2, 88-3, 88-4 represents digit 1(one) when connected to the contact area 88-0 and digit 0(zero) when not connected. Dividing a circular area **86*a* into ten equal sectors (represented in FIG. 4 by digits 0–9), the contact areas 88 are arranged such that the ten kinds of connections (each representing one of digits 0–9) shown in FIG. 5 occur in sequence as the disc 82 is rotated and the arms 84*a*, 84*b*, 84*c* and 84*d* of the contact plate 84** are positioned in these ten sectors in sequence.

In this manner the digital switch 80 provides a four-bit digital signal which indicates the position or angle of rotation of the disc 82 relative to the printed board 86. Since rotation of the disc 82 synchronizes with the rotation of the associted type wheel 52, the signal produced by the digital switch 80 represents the position of this type wheel 52 or, in other words, this signal tells which one of the imprinting types 42 of this wheel 52 is brought to the imprinting position. The signals produced by the plurality of digital switches 80 are transmitted to a converter (not shown) to be converted into a signal, i.e. signal $S_3$, which indicates actual arrangement of the imprinting types 42 on all of the type wheels 52.

Referring again to FIG. 1, the signal $S_3$ is compared with the data signal $S_1$ in the comparator 20 as described hereinbefore. This comparator 20 is of a conventional type and accordingly will not need any detailed description. The hydraulic cylinder 46, guide 40 and the hydraulic line 48, 50 in FIG. 2 correspond to the driving mechanism 30 in FIG. 1. The operation signal $S_4$ produced by the comparator 20 upon agreement of the type arrangement signal $S_3$ with the data signal $S_1$ energizes the electromagnetic valve 50 to apply hydraulic pressure to the cylinder 46. As the result, the imprinting head 38 is pushed towards the base 44 as seen in FIG. 3 to imprint the identification code on a member 74 of the car body such as a dash panel. (The type-setting mechanism 26) has been lowered so as to bring the base 44 and the imprinting head 38 to a destined imprinting position with the interposition of the panel 74.) Usually the imprinting is accomplished with the interposition of a copy tape 76 between the imprinting types 42 and the panel 74. If the comparator 20 finds any disagreement between the two signals $S_1$ and $S_3$, the comparator 20 does not supply the operation signal $S_4$ to the electromagnetic valve 50 but instead supplies the alarm signal $S_5$ to the alarm device 24 which may be a warning lamp and/or a buzzer, so that the imprinting head 38 does not move until completion of a correction action on either the type setting mechanism 26 or the instruction unit 16. Thus an incorrect imprinting can surely be precluded.

The type arrangement sensor is not limited to the digital switch 80 of FIG. 4 but may comprise a switching device of a different type, for example a rotary switch having a plurality of sets of contacts in a circumferential arrangement for each type wheel 52. Of course the construction of the type-setting mechanism 26 may be different from that described hereinbefore and shown in FIG. 3.

Figure 6:
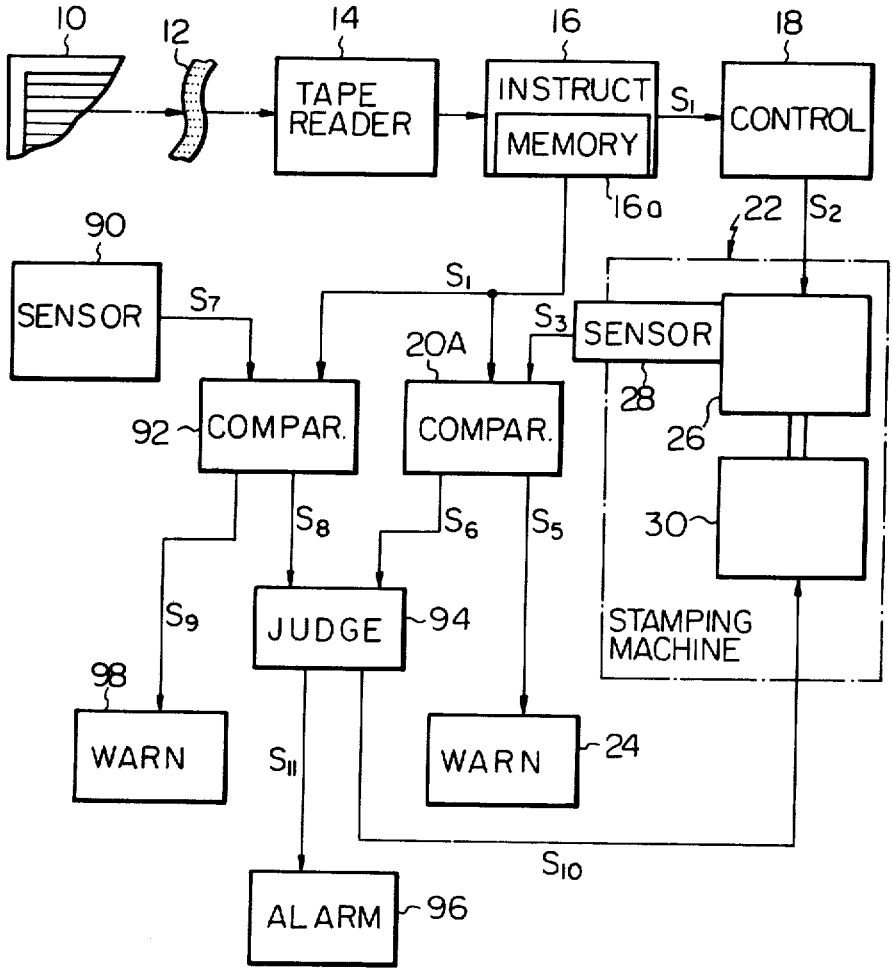
FIG. 6 is a block diagram of an automated imprinting system as another embodiment of the invention.

FIG. 6 shows a system according to the invention for imprinting identification code on various types and/or models of automobiles being assembled on one assembly line in an order specified in a production program. As a substantial difference of this system from that of FIG. 1, this system includes a sub-system for detecting the type and/or model (will be referred to merely as model) of each half-assembled car to be subjected to imprinting and utilizes the result of the detection together with the above described type arrangement signal $S_3$ in producing a control signal to allow a stamping action of the stamping machine 22. In the system of FIG. 6, the following components are similar to those in the system of FIG. 1: the instruction unit 16 provided with the tape reader 14, the control unit 18, the stamping machine 22 and the type arrangement sensor 28.

A comparator 20A in this system is functionally analogous to the comparator 20 in FIG. 1. This comparator 20A compares the type arrangement signal $S_3$ with the data signal $S_1$ and provides the warning signal $S_5$ to the warning device 24 if the compared signals $S_1$ and $S_3$ do not agree with each other. When the compared signals $S_1$ and $S_3$ are in agreement, the comparator 20A provides a signal $S_6$ which implies the agreement of the two signals $S_1$, $S_3$ and hence correctness of the arrangement of the imprinting types 42 to a judgement unit 94, which will be described hereinafter.

A car model sensor 90 detects the model of a half-assembled car or car body arrived at the imprinting spot and supplies a car model signal $S_7$ to a comparator 92, and the data signal $S_1$ is supplied from the instruction unit 16 to this comparator 92, too. This comparator 92 compares the car model signal $S_7$ with the data signal $S_1$, more particularly with a car model component (the component "PL810" of the identification code "PL810-123456") of the data signal $S_1$. When the compared signals $S_1$ and $S_7$ agree with each other (meaning that the car body arrived at the imprinting spot is of an expected model), the comparator 92 provides a signal $S_8$ which implies the correctness of the car model to the judgement unit 94. If the compared signals $S_1$ and $S_7$ do not agree with each other, the comparator 92 does not produce the correctness signal $S_8$ but provides a warning signal $S_9$ to a warning device 98. The judgement unit 94 provides an operation signal $S_{10}$ (corresponds to the operation signal $S_4$ in FIG. 1) to the driving mechanism 30 (to the electromagnetic valve 50 in FIG. 2) of the stamping machine 22 only when both of the two correctness signals $S_6$ and $S_8$ are supplied thereto at a predetermined moment, so that the imprinting of the identification code on the car body is effected only when the imprinting types 42 are arranged properly and at the same time the car body arrived at the imprinting spot is of a model in accordance with the production program. If either one or both of the signals $S_6$ and $S_8$ is not supplied at the predetermined moment, the judgement unit 94 does not provide the operation signal $S_{10}$ since an imprinting operation under such a situation will result in an erroneous identification code imprinting. Preferably, the judgement unit 94 is constructed so as to provide an alarm signal $S_{11}$ to an alarm device 96 when the signal $S_6$ and/or the signal $S_8$ is not supplied at the predetermined moment. In this case it will be convenient that the warning devices 24 and 98 are lamps of different colors while the alarm device 96 is a buzzer.

As a modification, the judgement unit 94 may be constructed so as to provide, instead of the operation signal $S_{10}$, a signal which implies that there is no possibility of an erronous imprinting. In this case the driving mechanism 30 of the stamping machine 22 will be actuated by an external operation signal.

Figure 7:
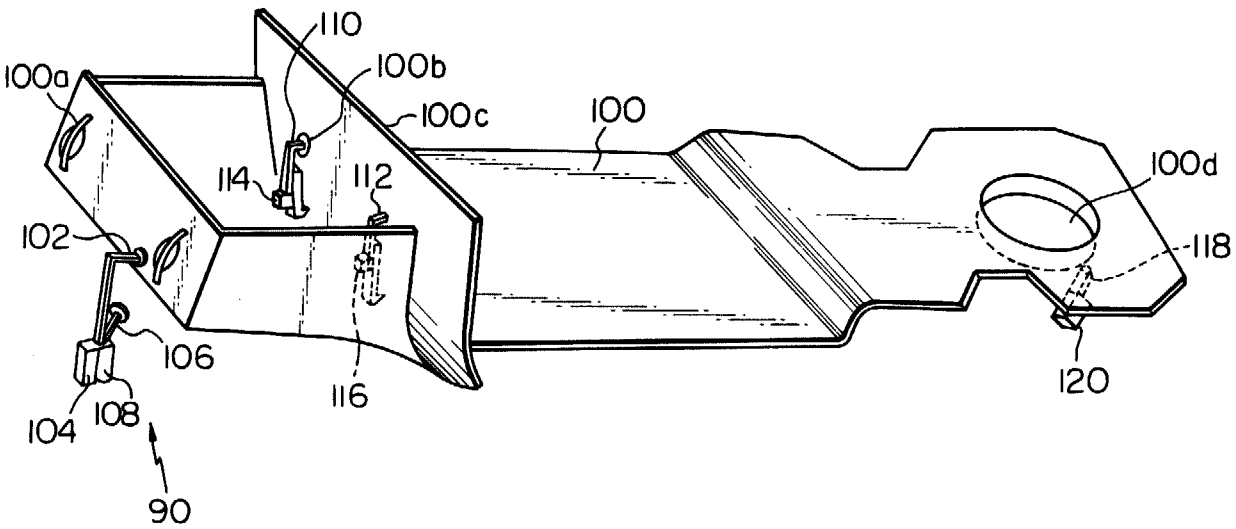
FIG. 7 is a perspective view of a floor portion of a car body and shows a method of detecting the type of the car body in the system of FIG. 6.

FIG. 7 shows the particulars of the car model sensor 90 by way of example. Indicated at 100 is a floor portion of the car body arrived at the imprinting spot. The sensor 90 is mounted on a wheeled bed which can move along the assembly line.

The sensor 90 has an arm 102 which makes a swing or pivot motion when it is pushed at its one end, and a switch 104, which may be a microswitch or a limit switch, is combined with the arm 102 such that the motion of the arm 102 causes the switch 104 to close (or to open). In addition there is a similar combination of an arm 106 located not so long from the arm 102 and a switch 108. The two arms 102 and 106 are directioned differently such that the free end of the arm 106 is positioned with a specific relation to the position of the free end of the arm 102. These arms 102 and 106 are arranged such that, when the sensor 90 is brought to a position for the detection of the model of the car body, both, either or neither of the arm 102 and the arm 106 collide against a radiator core **100*a* of the car body 100 depending on the shape of the radiator core 100*a*. Accordingly, both, either or neither of the two switches 104 and 108 are closed depending on the shape of the radiator core 100*a***. Since the shape of the radiator core 100*a* is an indication of the model of an engine to be installed on this car body 100 and hence the model of the car, a realized combination of the on-or-off state of the two switches 104 and 108 serves as a car model signal, at least as a component of such a signal.

To detect the position of an aperture 100*b* in a dash panel 100*c* for the installation of a steering shaft, the sensor 90 has two parallel-arranged detection arms 110 and 112 respectively combined with switches 114 and 116. When the aperture 100*b* is in the right-hand side region of the panel 100*c*, the arm 110 passes through the aperture 100*b* but the other arm 112 collide against the panel 100*c*, resulting in that the switch 116 closes but the other switch 114 remains open. If the switch 116 does not close but the switch 114 closes, the dash panel 100*c* must have the steering shaft aperture (100*b*) in the left-hand side region. Thus the on-or-off state of the switches 114 and 116 indicates the steering wheel position for the examined car body 100.

In many cases, the type of the car body 100 can be identified from the position of a deformed portion 100*d* for the installation of a spare time. For example, the deformed portion 100*d* will exist in a rear-left region of the floor when the car body 100 is for a hard-top but in a central region for a sedan. Accordingly the sensor 90 may have an additional detection arm 118 combined with a switch 120 in order to detect the position of the deformed portion 100*d* for a spare tire.

The sensor 90 has the function of producing a digital signal, i.e. the car model signal $S_7$, from the on-or-off state of the respective switches 104, 108, 114, 116, 120.

It will be apparent that the items chosen for the car model detection in FIG. 7 are exemplary and that any additional or alternative item may be employed to accomplish the same object.

As will have been understood from the foregoing description, an imprinting system according to the invention is particularly suitable for use in an automobile assembly line and is advantageous because of assuredness in the preclusion of the imprinting of an incorrect identification code and needing no manpower to accomplishe not only the setting of the imprinting types but also the confirmation of both the resultant type arrangement and the model of a half-assembled car subject to imprinting.

What is claimed is:

1. A system for imprinting identification code on individuals of automobiles of various types or models being assembled on one assembly line in an order specified in a production program, the system comprising:

a control unit to produce an electrical data signal representing an identification code specified in the production program;

a control unit to produce an electrical control signal representing the identification code based on said data signal;

an automated stamping machine having a type-setting mechanism which sets up imprinting types into an arrangement corresponding to the identification code in response to said control signal supplied from said control unit and a driving mechanism to carry out a stamping action in response to an electrical operation signal;

a sensor for detecting actual arrangement of said imprinting types and producing an electrical signal representing the detected type arrangement;

a first comparator which compares the type arrangement signal supplied from said sensor with said data signal supplied from said instruction unit and produces a first correctness signal only when the compared signals agree with each other but produces a warning signal if the compared signals do not agree with each other;

a sensor for detecting the type or model of a car body on which the identification code is to be imprinted and producing an electrical car model signal representing the detecting car model;

a second comparator which compares said car model signal with a car model component of said data signal supplied from said instruction unit and produces a second correctness signal only when the compared signals agree with each other but produces a warning signal if the compared signals do not agree with each other; and a judgement unit which provides said operation signal to said stamping machine only when both said first and second correctness signals are supplied thereto at a predetermined moment.

2. A system according to claim 1, wherein said instruction unit comprises a tape reader to read a punched tape which stores the contents of the production program.

3. A system according to claim 1, wherein said judgement unit produces an alarm signal if at least one of said first and second correctness signals is not supplied thereto at the predetermined moment.

4. A system according to claim 1, wherein said sensor for detecting the type or model of the car body comprises at least one probe having a switch capable of closing or opening in dependence on the shape or position of a specific part of a car body.

5. A system according to claim 4, wherein said specific part of a car body is one of an aperture for steering wheel, a radiator core and a deformed part for installation of a space tire.

6. A system according to claim 1, wherein said type-setting mechanism comprises a plurality of type wheels in parallel arrangement, each of said type wheels having a plurality of imprinting types on the periphery thereof in circumferentially uniformly spaced arrangement, an actuator for each of said type wheels, a gear train for each type wheel to rotate it stepwise by the action of said actuator and an electromagnetic valve for each actuator to control the application of a fluid pressure to said actuator in response to said control signal.

7. A system according to claim 6, wherein said sensor for detecting the type arrangement comprises a plurality of digital switches respectively assigned to said type wheels, each of said digital switches producing a digital signal representing the angular position of the assigned type wheel with respect to the axis of rotation.

8. A system according to claim 7, wherein said digital switch has a rotatable plate associated with said gear train for the assigned type wheel, a stationary plate arranged parallel to said rotatable plate, and a plurality of sets of contacts which are arranged between said rotatable plate and said stationary plate and are capable of individually and selectively closing and opening in dependence on the angle of rotation of said rotary plate relative to said stationary plate.

* * * * *